US008567780B2

(12) United States Patent
Yoshida

(10) Patent No.: US 8,567,780 B2
(45) Date of Patent: Oct. 29, 2013

(54) SHEET DISCHARGING DEVICE AND IMAGE FORMING APPARATUS

(75) Inventor: Takeshi Yoshida, Osaka (JP)

(73) Assignee: Kyocera Mita Corporation (JP)

( * ) Notice: Subject to any disclaimer, the term of this patent is extended or adjusted under 35 U.S.C. 154(b) by 812 days.

(21) Appl. No.: 12/632,431

(22) Filed: Dec. 7, 2009

(65) Prior Publication Data

US 2010/0150634 A1 Jun. 17, 2010

(30) Foreign Application Priority Data

Dec. 16, 2008 (JP) ..... 2008-319411

(51) Int. Cl.
*B65H 29/54* (2006.01)

(52) U.S. Cl.
USPC ..... 271/306; 271/184; 271/185; 271/188; 271/207

(58) Field of Classification Search
USPC ..... 271/177, 306, 184, 185, 188, 190
See application file for complete search history.

(56) References Cited

U.S. PATENT DOCUMENTS

| | | | | |
|---|---|---|---|---|
| 5,963,754 | A * | 10/1999 | Itoh et al. | 399/21 |
| 6,412,774 | B1 * | 7/2002 | Saito et al. | 271/220 |
| 2006/0066032 | A1 * | 3/2006 | Terao et al. | 270/58.11 |
| 2008/0044214 | A1 | 2/2008 | Nakajima | |
| 2008/0284091 | A1 * | 11/2008 | Sekiyama et al. | 271/226 |

FOREIGN PATENT DOCUMENTS

| | | |
|---|---|---|
| JP | 8-34526 | 2/1996 |
| JP | 2001-270642 | 10/2001 |
| JP | 2004-307157 | 11/2004 |
| JP | 2005239424 | 9/2005 |
| JP | 2008-44771 | 2/2008 |

* cited by examiner

*Primary Examiner* — Michael McCullough
*Assistant Examiner* — Howard Sanders
(74) *Attorney, Agent, or Firm* — Gerald E. Hespos; Michael J. Porco; Matthew T. Hespos

(57) ABSTRACT

A sheet discharging device, comprising: a housing including a first wall; a discharge section configured to discharge a sheet to an outside of the housing through a slit defined in the first wall; a pressing portion attached to the housing so that the pressing portion presses the sheet discharged through the slit outside the slit; and a moving unit configured to move the pressing portion along the slit.

11 Claims, 12 Drawing Sheets

SHEET DISCHARGING DEVICE AND IMAGE FORMING APPARATUS

BACKGROUND OF THE INVENTION

1. Field of the Invention

The present invention relates to a discharging device configured to discharge a sheet with correcting curls of the sheet at its lateral edges resulting from heat generated during a toner fixing process and to an image forming apparatus including the discharging device.

2. Description of the Related Art

An image forming apparatus generally fixes a toner image to a sheet passing between a heating roller and a pressure roller after the sheet is subjected to an image forming process to form the toner image. The sheet may be curled due to heat transferred thereto during the fixing process.

As a method for correcting curls of a sheet, an image forming apparatus may include curtain members for correcting the curls of the sheet. The curtain members are, for example, configured to press lateral edges of the sheet curled upward immediately while the sheet is discharged onto a discharge tray. While the sheet is discharged onto the discharge tray, the curled lateral edges of the sheet are pressed by the curtain members, so that the surface of the sheet is restored to a straight surface. The curtain members may temporarily or instantaneously correct the curls, but it does not completely correct the curls of the sheet. Therefore the sheet on the discharge tray is curled again.

As another method for correcting curls of the sheet, the image forming apparatus may include pressing plates pivotably hanging down. The pressing plates are, for example, configured or arranged to press the lateral edges of the sheet on the discharge tray. The lateral edges of the sheet on the discharge tray are pressed by the pressing plate, so that a preceding sheet may not interfere with a subsequent discharge of the sheet.

These methods, however, may be applied only to a single size of the sheet. For example, the curtain members or the pressing plates deployed to press the lateral edges of the largest sheet may not press those of smaller sheet. Therefore, curls of the smaller sheets may not be corrected.

SUMMARY OF THE INVENTION

In order to overcome the drawbacks residing in the prior art, an object of the present invention is to provide a sheet discharging device and an image forming apparatus configured to correct curls of various sizes of sheets.

One aspect according to the present invention is directed to a sheet discharging device, comprising a housing including a first wall; a discharge section configured to discharge a sheet to an outside of the housing through a slit defined in the first wall; a pressing portion attached to the housing so that the pressing portion presses the sheet discharged through the slit outside the slit; and a moving unit configured to move the pressing portion along the slit.

Another aspect according to the present invention is directed to an image forming apparatus, comprising an image forming unit configured to form a toner image on a sheet; a fixing unit configured to fix the toner image to the sheet by providing heat to the sheet; and a sheet discharging device configured to discharge the sheet bearing the toner image fixed thereof, wherein the sheet discharging device includes: a housing including a first wall; a discharge section configured to discharge a sheet to an outside of the housing through a slit defined in the first wall; a pressing portion attached to the housing so that the pressing portion presses the sheet discharged through the slit outside the slit; and a moving unit configured to move the pressing portion along the slit.

DETAILED DESCRIPTION OF THE PREFERRED EMBODIMENTS

Hereinafter, one embodiment according to the present invention is described with reference to the accompanying drawings. Terms to indicate direction such as "front", "back", "up", "down", "left" and "right" in the following description are merely used for the purpose of clarifying the description and do not limit the present invention at all. "Front" and similar terms indicate a direction in which a user operating an image forming apparatus is located unless otherwise described. "Back" and similar terms indicate a side opposite to the "front" side. "Left", "right" and similar terms indicate directions to the "left" or "right" of the "front" side. A term "sheet" means a copy sheet, a tracing paper, a cardboard, an OHP sheet or any other sheet on which a toner image may be formed. "Lateral edges of a sheet" or similar terms mean edges of the sheet substantially parallel to a sheet conveying direction. "Upstream", "downstream" and similar terms mean upstream and downstream with respect to the sheet conveying direction unless otherwise described.

Figure 1:
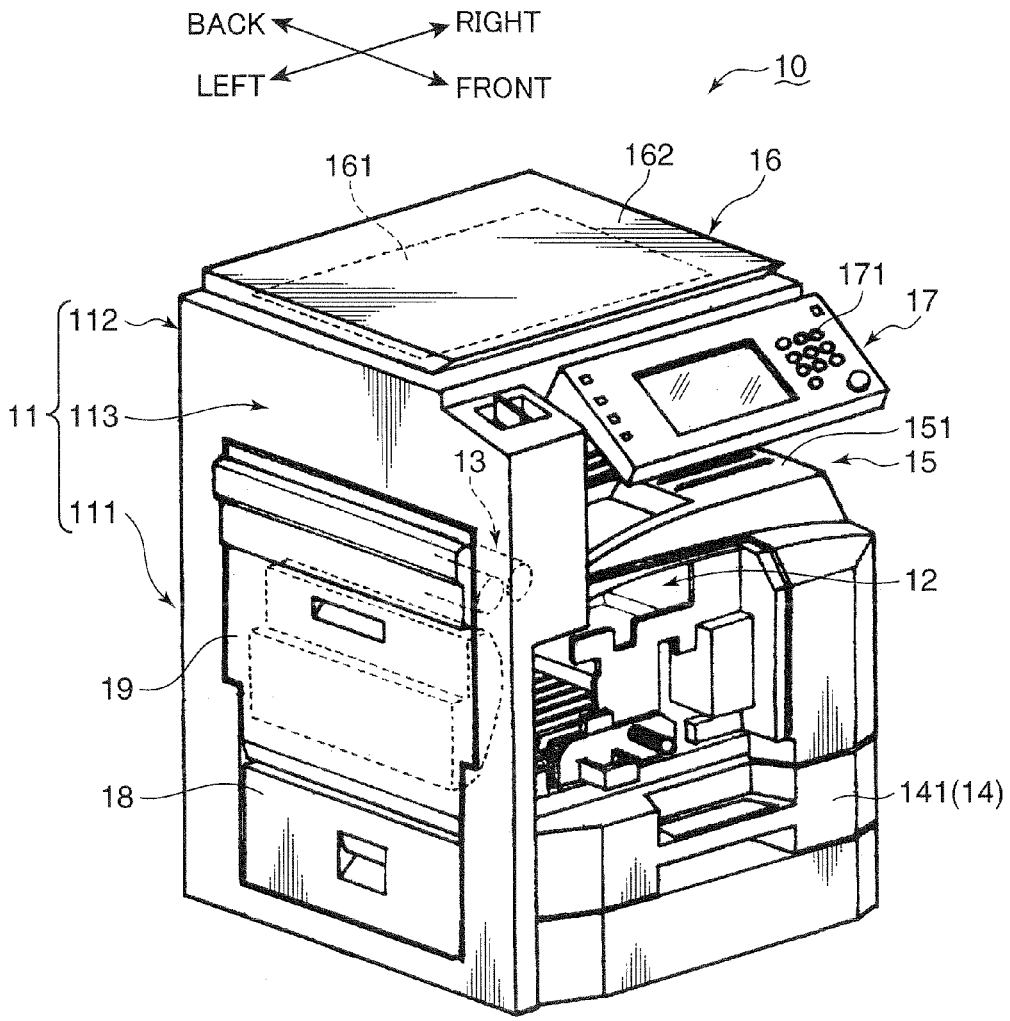
FIG. 1 is a perspective view of an image forming apparatus according to one embodiment of the invention with a front cover detached.

FIG. 1 is a perspective view of an image forming apparatus according to one embodiment of the present invention. A front cover of the image forming apparatus shown in FIG. 1 is detached and internal configurations of the image forming apparatus are partly shown in FIG. 1. Although the image forming apparatus shown in FIG. 1 is a copier so-called as internal discharge type, the present invention is not limited thereto and may be a printer, a facsimile machine, a complex machine with these functions or any other apparatus configured to a toner image on the sheet.

The image forming apparatus 10 includes a substantially rectangular parallelepipedic housing 11. The housing 11 includes a substantially rectangular parallelepipedic lower housing 111, a flat upper housing 112 disposed above the lower housing 111 and a connecting housing 113 disposed between the lower housing 111 and the upper housing 112. The connecting housing 113 extends from a left part of the lower housing 111 to a left part of the upper housing 112. The upper housing 112 is supported above the lower housing 111 by the connecting housing 113. Accordingly, the housing 11 is substantially C-shaped. A hollow part surrounded with the lower housing 111, the upper housing 112 and the connecting housing 113 is used as a discharge section 15 where the sheets on which toner images are formed are discharged and stored. The image forming apparatus with such a discharge section 15 is generally called as the internal discharge type. The present invention is not limited to horizontal sheet discharge as shown in FIG. 1, and the image forming apparatus 10 may vertically discharge sheets.

A storing unit 14 configured to store the sheets, an image forming unit 12 configured to form a toner image on the sheet and a fixing unit 13 configured to fix the toner image to the sheet are arranged in the lower housing 111. An image reading unit 16 configured to read an image of a document to be copied is installed in the upper housing 112. The image forming apparatus 10 further includes an operation panel 17 projecting toward a user (toward the front side) from the front edge of the upper housing 112.

Figure 2:
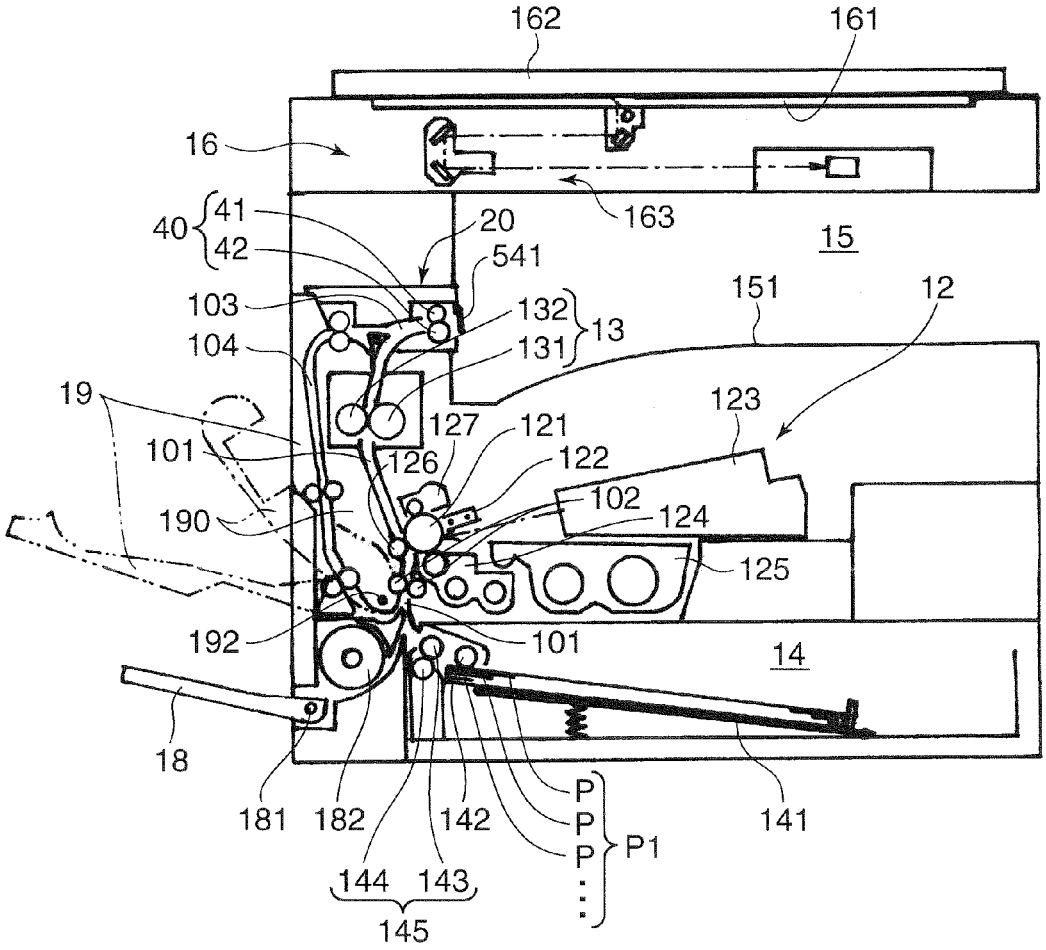
FIG. 2 is a diagram showing an internal configuration of the image forming apparatus shown in FIG. 1.

FIG. 2 schematically shows the internal configuration of the image forming apparatus 10 shown in FIG. 1. The configuration of the image forming apparatus 10 is described with reference to FIG. 1 as well as FIG. 2.

The operation panel 17 includes a numerical keypad 171, a LCD touch panel (liquid crystal panel) 172 and operation keys. The user may enter process information on an image forming process with the operation panel 17. For example, the user may enter the number of sheets to be printed using the numerical keypad, may adjust toner density with the touch panel 172 or may turn the image forming apparatus 10 on and off with the operation key.

The image reading unit 16 includes a contact glass 161 mounted in an opening defined in the upper surface of the upper housing 112. The contact glass 161 is used to put a document thereon. The image reading unit 16 further includes a cover 162, which is vertically rotatable, mounted on the upper housing 112. The cover 162 presses the document on the contact glass 161. The image reading unit 16 further includes a scanning mechanism 163. The scanning mechanism 163 scans the image of the document on the contact glass 161 to convert an analog signal of the document image into a digital signal.

The storing unit 14 includes a cassette 141 detachably inserted into the lower housing 111. The cassette 141 accommodates a sheet stack P1 including a plurality of stacked sheets P one over another. The image forming apparatus 10 includes a pickup roller 142 held in contact with the upper surface of the sheet stack P1 in the cassette 141 and a roller pair 145 including a feed roller 143 configured to feed the sheet after the pickup roller 142 toward the image forming unit 12 and a separation roller 144 configured to return to the cassette 141 lower sheets in a plurality of sheets P picked up and fed by the pickup roller 142. The pickup roller 142 and the roller pair 145 feed the sheets P one by one from the sheet stack P1 in the cassette 141 to the image forming unit 12. The image forming unit 12 forms a toner image on the sheet (printing process). Although the single cassette 141 is used in the storing unit 14 in FIG. 2, the present invention is not limited thereto and, for example, a multi-level cassette assembly including a plurality of cassettes 141 placed one over another may be used.

The image forming apparatus 10 includes a manual feed tray 18. The manual feed tray 18 is disposed in a lower part of the left surface of the lower housing 111. Supporting shafts 181 configured to support the manual feed tray 18 are disposed at the right edge of the manual feed tray 18. The manual feed tray 18 rotates about the supporting shafts 181 between a closed position where it is substantially parallel to the left surface of the lower housing 111 and an opened position where it projects leftward from the left surface of the lower housing 111. The manual feed tray 18 at the closed position closes a sheet conveyance path from the manual feed tray 18 to the interior of the lower housing 111. The manual feed tray 18 at the opened position opens the conveyance path for the sheet P from the manual feed tray 18 to the interior of the lower housing 111. The user may put the sheets one by one to be subjected to the image forming process on the manual feed tray 18. The image forming apparatus 10 includes a roller 182 arranged above a proximal end of the manual feed tray 18. The roller 182 feeds the sheet placed on the manual feed tray 18 toward the image forming unit 12.

The image forming apparatus 10 further includes a maintenance door 19 disposed on the left surface of the lower housing 111 and above the manual feed tray 18. The maintenance door 19 rotates between a closed position where it is substantially parallel to the left surface of the lower housing 111 and an opened position where it projects leftward from the left surface of the lower housing 111. A user may open the maintenance door 19 when the sheet P is jammed in the lower housing 111 to access and remove the jammed sheet.

The image forming apparatus 10 further includes a cover member 190 disposed in the upper housing 111. The cover member 190 is disposed adjacent to the maintenance door 19. The bottom end of the cover member 190 disposed above that of the maintenance door 19 includes supporting portions 192 connected with the lower housing 111. The cover member 190 is rotatable about the supporting portions 192 between a closed position (shown by solid line in FIG. 2) and an opened position (shown by chain double-dashed line in FIG. 2). The cover member 190 at the closed position is substantially parallel to the maintenance door 19 at the closed position. The upper end of the cover member 190 at the opened position is located to the left side with respect to the left surface of the lower housing 111.

The inner surface (right surface) of the cover member 190 at the closed position forms a conveyance path 101 configured to guide the sheet P fed from the cassette 141 and/or the manual feed tray 18 toward the image forming unit 12 and then to guide it from the image forming unit 12 toward the fixing unit 13. A conveyance path 104 is defined between the outer surface (left surface) of the cover member 190 at the closed position and the inner surface (right surface) of the maintenance door 19 at the closed position. The conveyance path 104 is used to guide a sheet to be subjected to both side printing with the image forming unit 12.

When opening the maintenance door 19, the user may remove the sheet P jammed in the conveyance path 104 as described above. When opening the cover member 190 together with the maintenance door 19, the user may access and remove the sheet P jammed in the conveyance path 101.

As described above, the sheet P fed from the cassette 141 and/or the manual feed tray 18 are subjected to the image forming process (printing process) while passing in the conveyance path 101 between the right surface of the cover member 190 and the left surface of the image forming unit 12.

The image forming unit 12 includes a cylindrical photoconductive drum 121 disposed in the lower housing 111. The photoconductive drum 121 below the connecting housing 113 rotates clockwise about a shaft thereof. The image forming unit 12 further includes a charger 122 configured to uniformly charge the circumferential surface of the photoconductive drum 121. The charger 122 is disposed to the right of the photoconductive drum 121. The image forming unit 12 further includes an exposure device 123. A digital signal of a document image generated using the scanning mechanism 153 as described above is sent to the exposure device 123. The exposure device 123 irradiates the circumferential surface of the photoconductive drum 121 with a laser beam in accordance with the digital signal, so that an electrostatic latent image is formed on the circumferential surface of the photoconductive drum 121. The image forming unit 12 further includes a developing device 124. Toner supplied from the developing device 124 to the circumferential surface of the photoconductive drum 121 bearing the electrostatic latent image forms a toner image thereon. The toner is supplied to the developing device 124 from a toner container 125. The toner container 125 is disposed to the right of the developing device 124 (below the exposure device 123) and detachably mounted in the lower housing 111. After the toner in the toner container 125 is used up, the toner container 125 is replaced with a new toner container.

The image forming apparatus 10 further includes a registration roller pair 102 located before the photoconductive drum 121 and a transfer roller 126 disposed to the left of the photoconductive drum 121. The circumferential surface of the transfer roller 126 is in contact with that of the photoconductive drum 121 to define a nip portion. The registration roller pair 102 feeds the sheet P in the conveyance path 101 to the nip portion between the transfer roller 126 and the photoconductive drum 121. The transfer roller 126 electrostatically transfers a toner image on the photoconductive drum 121 to the sheet P passing the nip portion. Thereafter, the sheet P bearing the toner image is fed to the fixing unit 13.

The image forming unit 12 further includes a cleaning device 127 above the photoconductive drum 121. The cleaning device 127 cleans the circumferential surface of the photoconductive drum 121 after the toner image is transferred to the sheet P. The cleaned circumferential surface of the photoconductive drum 121 is charged again by the charger 122 and subjected to the formation of a new toner image.

The fixing unit 13 includes a substantially cylindrical fixing roller 131 and a pressure roller 132 disposed to the left of the fixing roller 131, in which an electric heating element (e.g. halogen lamp) is disposed. The pressure roller 132 is pressed into contact with the fixing roller 131 to define a nip portion between the circumferential surfaces of the fixing roller 131 and the pressure roller 132. While the sheet P passes the nip portion, the toner on the sheet P is melted by heat energy from the fixing roller 131, and then the sheet P is pressed against the fixing roller 131 by the pressure roller 132, so that the toner is fixed onto the sheet P.

The image forming apparatus 10 includes a sheet discharging device 20 above (downstream of) the fixing unit 13. The sheet discharging device 20 includes a discharge roller pair 40 adjacent to the discharge section 15. The discharge roller pair is disposed in the connecting housing 113. The sheet P after the toner image is fixed moves to the discharge roller pair 40 under guidance of a conveyance path 103 extending between the fixing unit 13 and the discharge roller pair 40. If the user operates the operation panel 17 for simplex printing, the discharge roller pair 40 feed the sheet P to the discharge section 15. If the user operates the operation panel 17 for duplex printing, the discharge roller pair 40 is rotated in a reverse direction to pull the sheet P into the connecting housing 113 (switch-back motion) after a part of the sheet P is discharged to an outside of the connecting housing 113. Thereafter, the sheet P is guided to the above-mentioned conveyance path 104 to reach the conveyance path 101. At this time, the sheet P is upside down with respect to the sheet P immediately after the cassette 141 or the manual feed tray 18 feeds it. The sheet P then moves to the image forming unit 12 from the conveyance path 101. The image forming unit 12 forms an image on the other side of the sheet P, and then the fixing unit 13 fixes a toner image on the other side of the sheet P. Thereafter, the sheet P subjected to both side printing is guided to the conveyance path 103 and discharged to the outside of the connection housing 113 by the discharge roller pair 40.

The discharge section 15 includes a discharge tray 151 configured to support the sheet P discharged by the discharge roller pair 40. A plurality of printed sheets P subjected to the printing process is stacked on the discharge tray 151.

Figure 3:
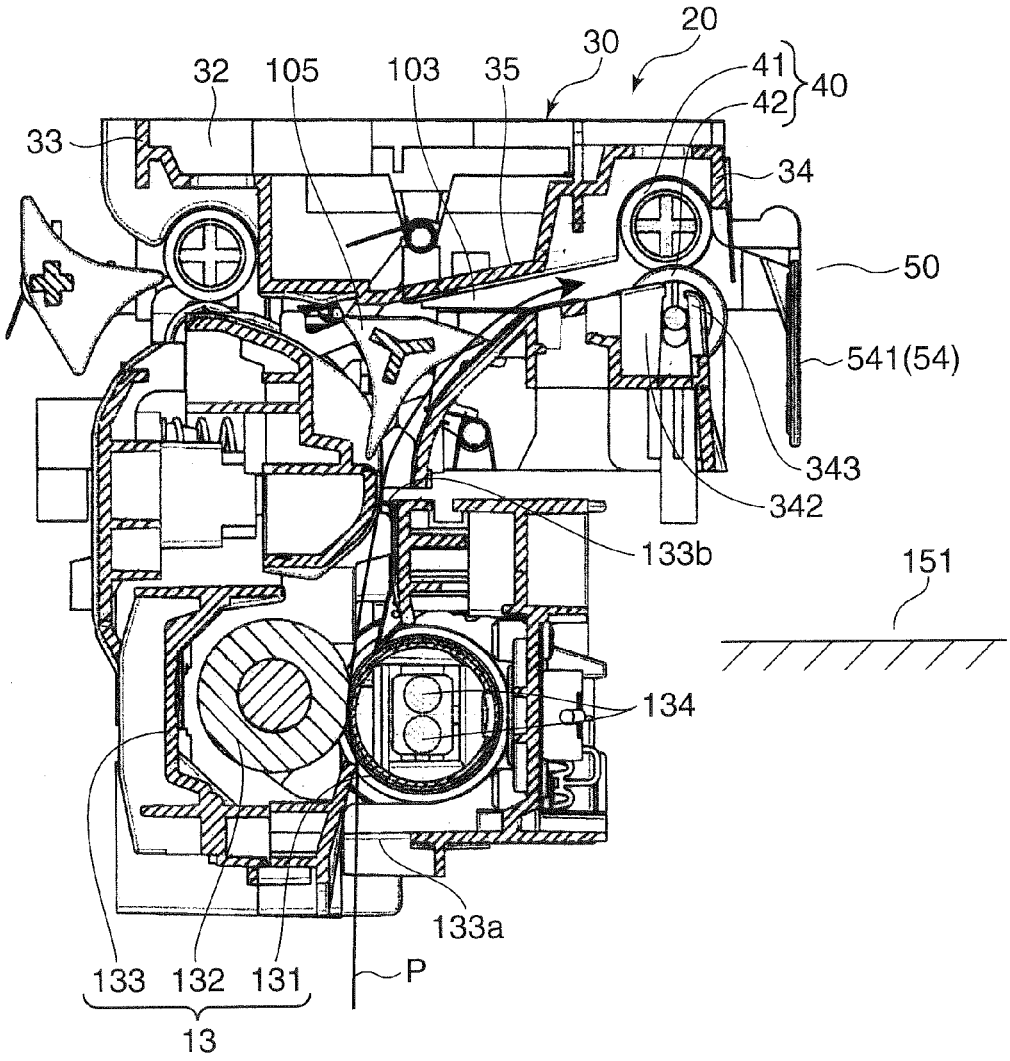
FIG. 3 is a section showing a positional relationship between a fixing unit and a sheet discharging device of the image forming apparatus shown in FIG. 1.

FIG. 3 is a front view in section of the fixing unit 13 and the sheet discharging device 20 described with reference to FIG. 2. With reference to FIG. 3, the configurations of the fixing unit 13 and the sheet discharging device 20 are further described.

In addition to the fixing roller 131 and the pressure roller 132, the fixing unit 133 further includes a housing 133 formed to surround these rollers 131, 132. The fixing roller 131 is disposed in a right space in the housing 133 while the pressure roller 132 is disposed in a left space. As described above, the circumferential surface of the pressure roller 132 is pressed into contact with that of the fixing roller 131 to define the nip portion. As described above, the fixing roller 131 is heated by the electric heating element (e.g. halogen lamp) 134 in the fixing roller 131 if there is power supply to the electric heating element 134.

The housing 133 includes a bottom plate below both of the fixing roller 131 and the pressure roller 132 and a top plate above them. The bottom plate includes a carry-in port 133*a* defined substantially right below the nip portion between the fixing roller 131 and the pressure roller 132. The top plate includes a carry-out port 133*b* defined substantially right above the nip portion between the fixing roller 131 and the pressure roller 132. The carry-in port 133*a*, the nip portion and the carry-out port 133*b* are vertically aligned. The sheet P bearing the toner image transferred thereto in the image forming unit 12 is carried into the carry-in port 133*a*. The sheet P with the toner image fixed thereto is carried out from the carry-out port 133*b*.

A switching guide 105 in the form of a substantially triangular column is disposed at an intermediate position of the conveyance path 103 extending between the fixing unit 13 and the sheet discharging device 20. The switching guide 105 disposed substantially right above the carry-out port 133*b* is configured to switch the conveyance path of the sheet P between a path toward the discharge tray 151 and the one toward an outer discharge tray (not shown) located at the left side of the housing 11 (see FIG. 1). When the switching guide 105 determines the conveyance path of the sheet P to be the path toward the discharge tray 151, the sheet P carried out from the carry-out port 133*b* is fed to the discharge tray 151.

The sheet P carried into the housing 133 from the carry-in port 133*a* is subjected to heat energy from the fixing roller 131 in the nip portion between the fixing roller 131 and the pressure roller 132, so that the toner image is fixed to the sheet P. At this time, the toner image is located on the right surface (in FIG. 3) of the sheet P. The right surface of the sheet P directly receiving heat from the fixing roller 131 thermally expands to become relatively longer than the left surface of the sheet P. Consequently, the lateral edges of the sheet P discharged from the housing 133 are curled to the left.

When the switching guide 105 determines the conveyance path of the sheet P to be the path toward the discharge tray 151, as the conveyance path 103 is bent in an inverse L-shape and extends from the carry-out port 133*b* toward the discharge roller pair 40, the lateral edges of the sheet P fed from the discharge roller pair 40 to the discharge tray 151 are curled upward.

The sheet discharging device 20 includes a correcting portion 50 configured to press the lateral edges of such a curled sheet P.

Figure 4:
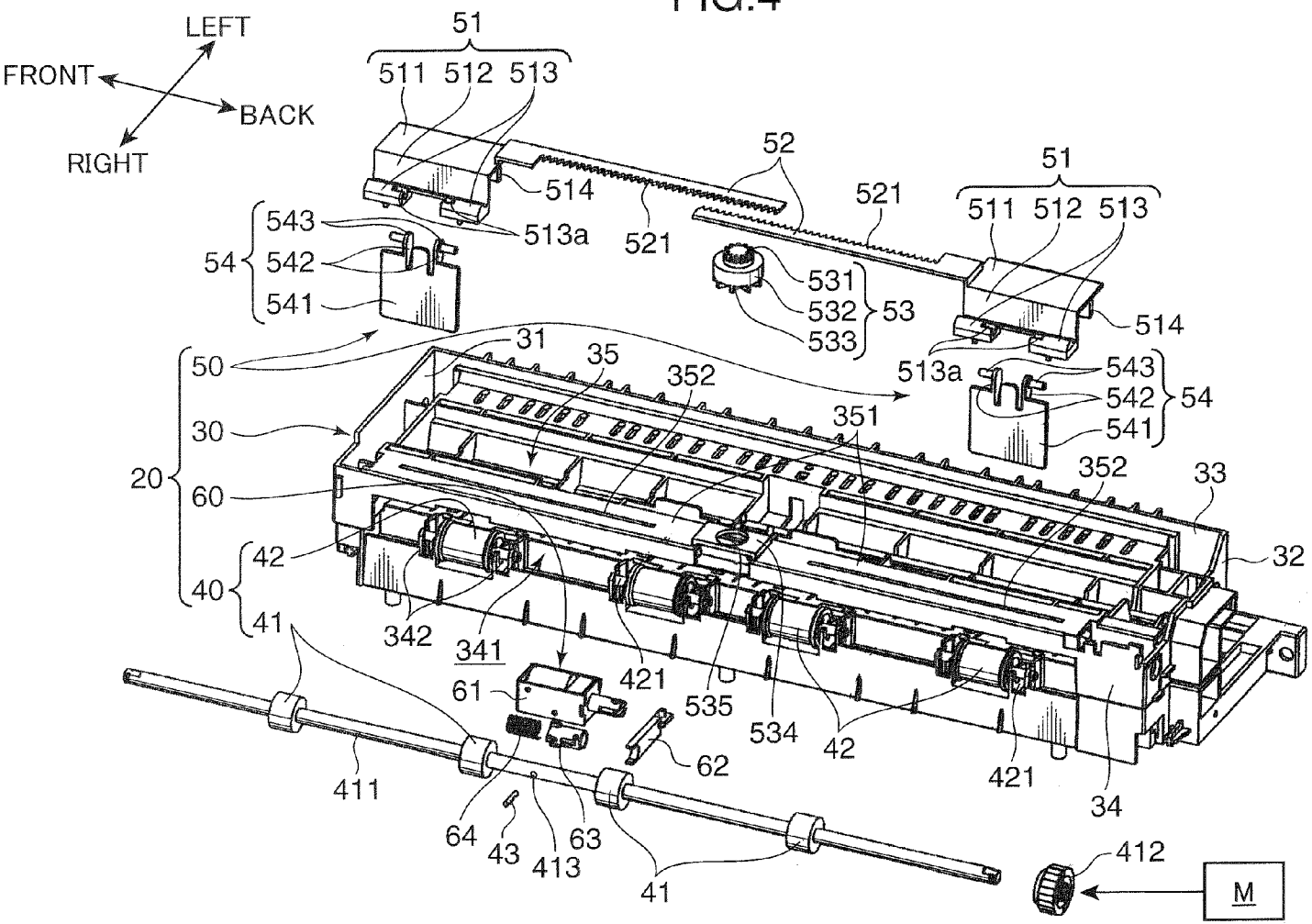
FIG. 4 is an exploded perspective view of the sheet discharging device shown in FIG. 3.

FIG. 4 is an exploded perspective view of the sheet discharging device 20 described with reference to FIGS. 2 and 3. The sheet discharging device 20 is described with reference to FIG. 3 as well as FIG. 4.

The sheet discharging device 20 configured to discharge the sheet P includes a substantially parallelepipedic casing 30 (housing) extending from the front surface to the rear surface of the connecting housing 113 (see FIG. 1). The casing 30 includes a front plate 31 and a rear plate 32. The front plate 31 is disposed at the front end of the casing 30 while the rear plate 32 is disposed at the rear end of the casing 30. The casing 30 further includes a left side plate 33 extending between the left edge of the front plate 31 and that of the rear plate 32 and a right side plate 34 (first wall) extending between the right edge of the front plate 31 and that of the rear plate 32. The right side plate 34 is formed with a slit 341 extending in a longitudinal direction (from the front side to the rear side) of the right side plate 34. The sheet P is discharged to the discharge tray 151 via the slit 341. The casing 30 further includes a top plate 35 to form the upper surface of the casing 30. A recess is defined at a widthwise central position of the top plate 35. The recess extends in the longitudinal direction of the casing 30 (from the front side to the rear side). A bottom part of the casing 30 is open so that the inner surface (lower surface) of the top plate 35 defines a part of the conveyance path 103. Accordingly, the sheet guided toward the discharge tray 151 by the switching guide 105 moves along the inner surface of the top plate 35. Thereafter, the sheet P is discharged onto the discharge tray 151 by the discharge rollers 40.

The sheet discharging device 20 further includes the discharge roller pair 40 (discharging portion) adjacent to the slit 341 defined in the right side plate 34 of the casing 30 for discharging the sheet via the slit 341. The discharge roller pair 40 includes an upper roller 41 and a lower roller 42 below the upper roller 41. FIG. 4 shows four upper rollers 41 and four lower rollers 42. The circumferential surfaces of these rollers are in contact with each other. In the present invention, three or less upper rollers 41 and three or less lower rollers 42 may be used or five or more upper rollers 41 and five or more lower rollers 42 may be used.

The plurality of the upper rollers 41 are connected to each other by a roller shaft 411. Both ends of the roller shaft 411 are respectively connected with the front plate 31 and the rear plate 32 of the casing 30. A gear 412 is mounted on the end of the roller shaft 411 connected with the rear plate 32. A driving force from a motor M (driving source) is transmitted to the gear 412, so that the roller shaft 411 integrally and concentrically rotates with the upper rollers 41. The transmission of the driving force to the gear 412 may be accomplished by engaging a drive gear mounted on a drive shaft of the motor M with the gear 412 or by using a transmission between the motor M and the gear 412.

The motor M is configured to rotate in forward and reverse directions. For example, when the motor M is rotated in the forward direction, the sheet P is conveyed toward the discharge tray 151. On the other hand, when the sheet P is caused to make a switch-back motion for duplex printing as described above, the motor M is rotated in the reverse direction.

The lower rollers 42 include roller shafts 421. The roller shaft 421 is rotatably supported by a plurality of brackets 342 adjacent to the right side plate 34 in the casing 30. The plurality of the brackets 342 extending toward the upper rollers 41 is configured to support both ends of the roller shafts 421. Each of the brackets 342 includes a vertically extending and substantially U-shaped slit 343 (See FIG. 3). Both ends of the roller shafts 421 are biased upwardly, for example, by coil springs (not shown) to press the circumferential surfaces of the lower rollers 42 into contact with those of the upper rollers 41. The sheet P reached the discharge roller pair 40 is fed toward the discharge tray 151 as the upper rollers 41 and the lower rollers 42 holds the sheet P.

The sheet discharging device 20 further includes the correcting portion 50. The correcting portion 50 is used to downwardly press the lateral edges of the sheet P fed to the discharge tray 151 by the discharge roller pair 40 and correct curls at the lateral edges of the sheet P. The correcting portion 50 includes bases 51 with an L-shaped cross section adjacent to the front plate 31 and the rear plate 32, respectively, and a pair of racks 52 (moving unit; first rack; second rack) extending from the respective bases 51 toward a longitudinal central position of the casing 30 (extending along the slit 341 of the right side plate 34). Teeth 521 of the pair of racks 52 face each other. The correcting portion 50 further includes a rotor 53 (moving unit) between the pair of racks 52. The rotor 53 includes a pinion 531 engaged with the teeth 521 of the pair of racks 52 and a substantially disk-shaped rack gear 532 concentrically connected with the lower surface of the pinion 531. The diameter of the rack gear 532 is larger than that of the pinion 531. Rack teeth 533 are formed on the lower surface of the rack gear 532. The rack teeth 533 are radially arranged at equal pitches and project downwardly. The correcting portion 50 further includes pressing plates 54 pivotably connected to the bases 51.

Each base 51 includes a horizontal plate 511, a vertical plate 512 extending downwardly from the right edge of the horizontal plate 511 and a pair of brackets 513 projecting rightward from the lower edge of the vertical plate 512. The pair of brackets 513 is used to support the pressing plate 54.

A right part of the top plate 35 of the casing 30 includes a pair of guide plates 351 configured to guide the bases 51. The pair of the guide plates 351 are substantially rectangular thin plates aligned along the right edge of the casing 30. Each of the guide plates 351 includes a guide slit 352 extending substantially in parallel with the right edge of the casing 30. A rib 514 projects downward from the lower surface of the horizontal plate 511. The rib 514 is inserted into the guide slit 352, so that movements of the base 51 as well as parts connected with the base 51 are guided by the guide slit 351.

One of the racks 52 includes the teeth 521 facing rightward while another rack 52 includes the teeth 521 facing leftward. The base 51 supporting the rack 52 including the teeth 521 facing rightward is mounted on the front guide plate 351 while the base 51 supporting the rack 52 including the teeth 521 facing leftward is mounted on the rear guide plate 351. At this time, a distance between edges of the racks 52 facing each other (edges formed with the teeth 521) is substantially equal to the diameter of the pinion 531.

A mount base 534 in the form of a thin plate slightly raised from the upper surfaces of the guide plates 351 is disposed between the pair of guide plates 351. A through hole 535 vertically extends in the center of the mount base 534. The diameter of the through hole 535 is larger than that of the pinion 531 and smaller than that of the rack gear 532. When the rotor 53 is mounted on the lower surface of the mount base 534, the pinion 531 projects upward from the mount base 534 through the through hole 535. A transmission assembly 60 is arranged further below the mount base 534. The transmission assembly 60 supports and rotates the rotor 53.

Figure 5:
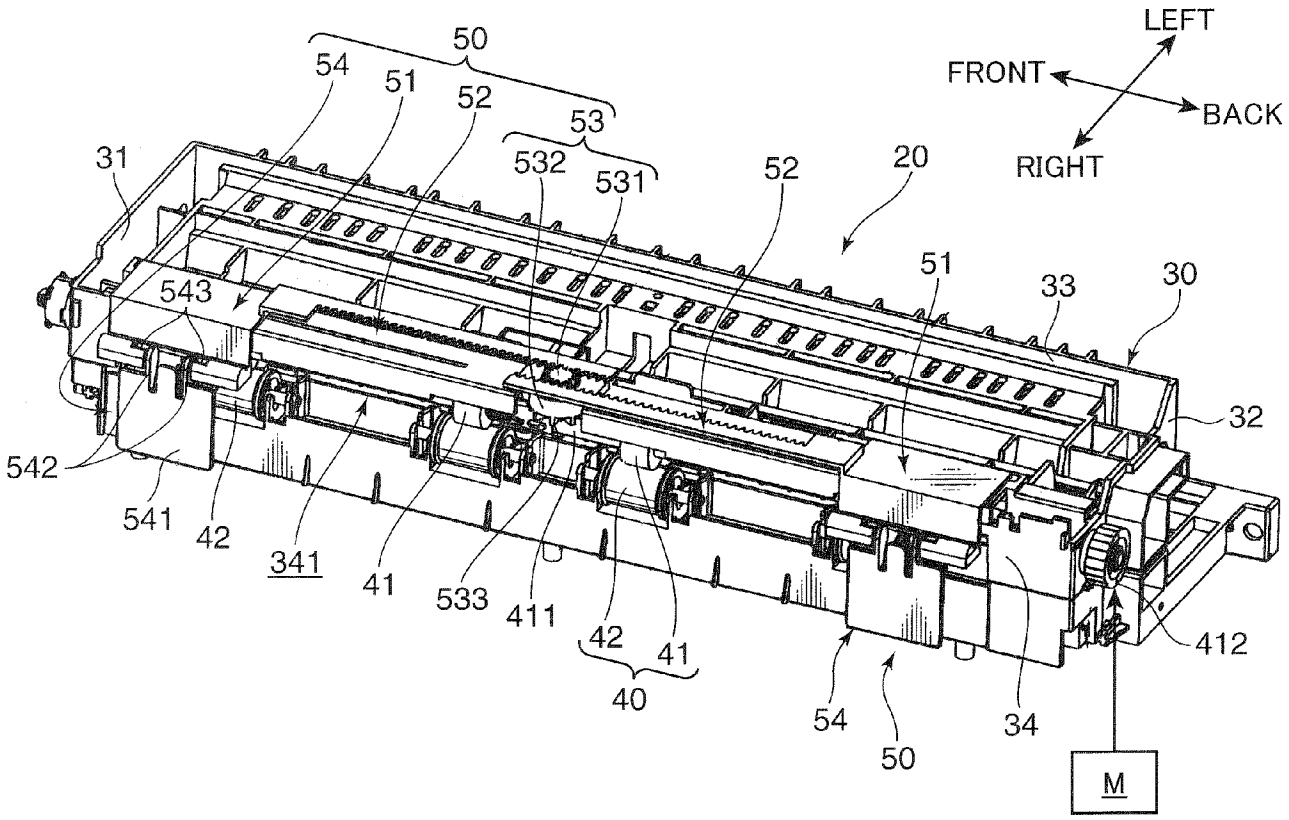
FIG. 5 is a perspective view of an assembly of the sheet discharging device shown in FIG. 4, where a pair of pressing plates in the sheet discharging device shown in FIG. 5 are the most distant from each other.
Figure 6:
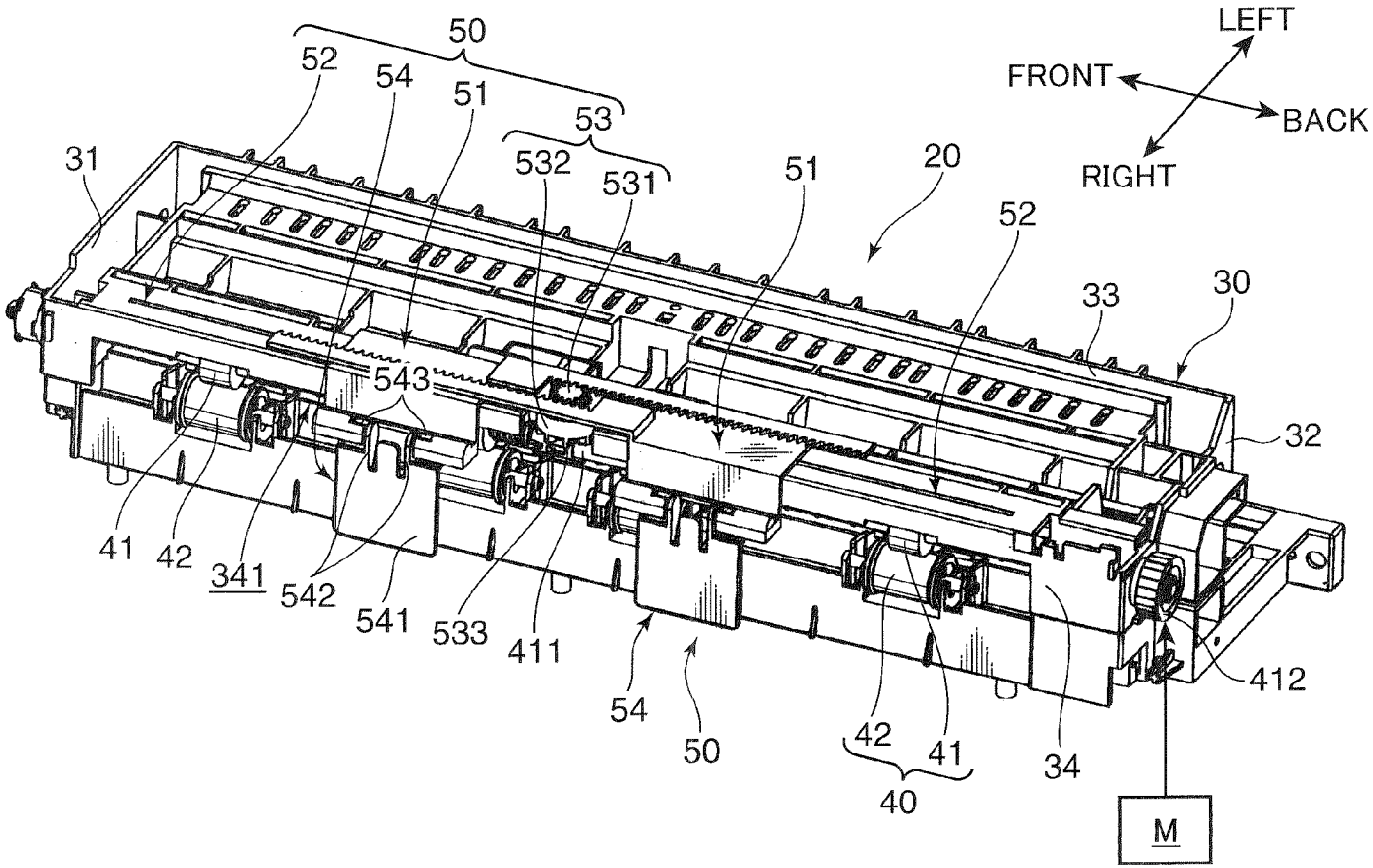
FIG. 6 is an perspective view of the assembly of the sheet discharging device shown in FIG. 4, where the pair of pressing plates in the sheet discharging device shown in FIG. 6 are the closest to each other.

FIGS. 5 and 6 are perspective views of the assembled sheet discharging device 20. The pair of the pressing plates 54 of the sheet discharging device 20 shown in FIG. 5 are most distant from each other. The pair of the pressing plates 54 of the sheet discharging device 20 shown in FIG. 6 are closest to each other. The configuration of the sheet discharging device 20 is further described with reference to FIG. 4 as well as FIGS. 5 and 6.

When the rotor 53 is rotated by the transmission assembly 60, the racks 52 engaged with the pinion 531 and the elements connected with the racks 52 move in parallel with the right edge of the casing 30. When the rotor 53 is rotated in one direction, the pressing plates 54 move along the slit 341 of the right side plate 34 so that they get closer to each other. When the rotor 53 is rotated in another direction, the pair of the pressing plates 54 move in directions away from each other along the slit 341 of the right side plate 34. Movements of the pair of pressing plates 54 are preferably symmetrical with each other with respect to a longitudinal central position of the slit 341.

Each pressing plate 54 (pressing portion; first pressing portion; second pressing portion) includes a substantially rectangular main plate 541, a pair of projecting pieces 542 extending upwardly from the upper edge of the main plate 541 and shafts 543 extending from the respective projecting pieces 542. A pair of the shafts 543 extending in opposite directions with each other are rotatably supported in the pair of the brackets 513. A distance between the outer surfaces of the projecting pieces 542 is smaller than a distance between the inner surfaces of the pair of brackets 513. Thus, the pair of the projecting pieces 542 may be inserted between the pair of brackets 513.

Recessed grooves 513*a* are formed along proximal edges of the upper surfaces of the respective brackets 513. The shafts 543 are fitted into the recessed grooves 513*a* so that the pressing plate 54 is pivotably connected to the brackets 513. The pressing plate 54 is pushed up by the discharged sheet P.

The main plates 541 partly close the slit 341 defined in the right side plate 34 of the casing 30. The positions of the main plates 541 are so adjusted as to correspond to the lateral edges of the sheet P to be discharged through the slit 341. The lateral edges of the sheet P discharged through the slit 341 move for the discharge tray 151 with pushing the main plates 541 up. During this time, the lateral edges of the upper surface of the sheet P are pressed by the weights of the main plates 541 to correct the curls.

Figure 7B:
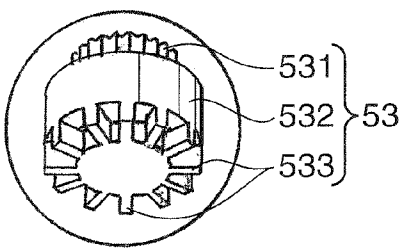
FIG. 7B is a perspective view of a rotor in the sheet discharging device shown in FIG. 3.
Figure 7A:
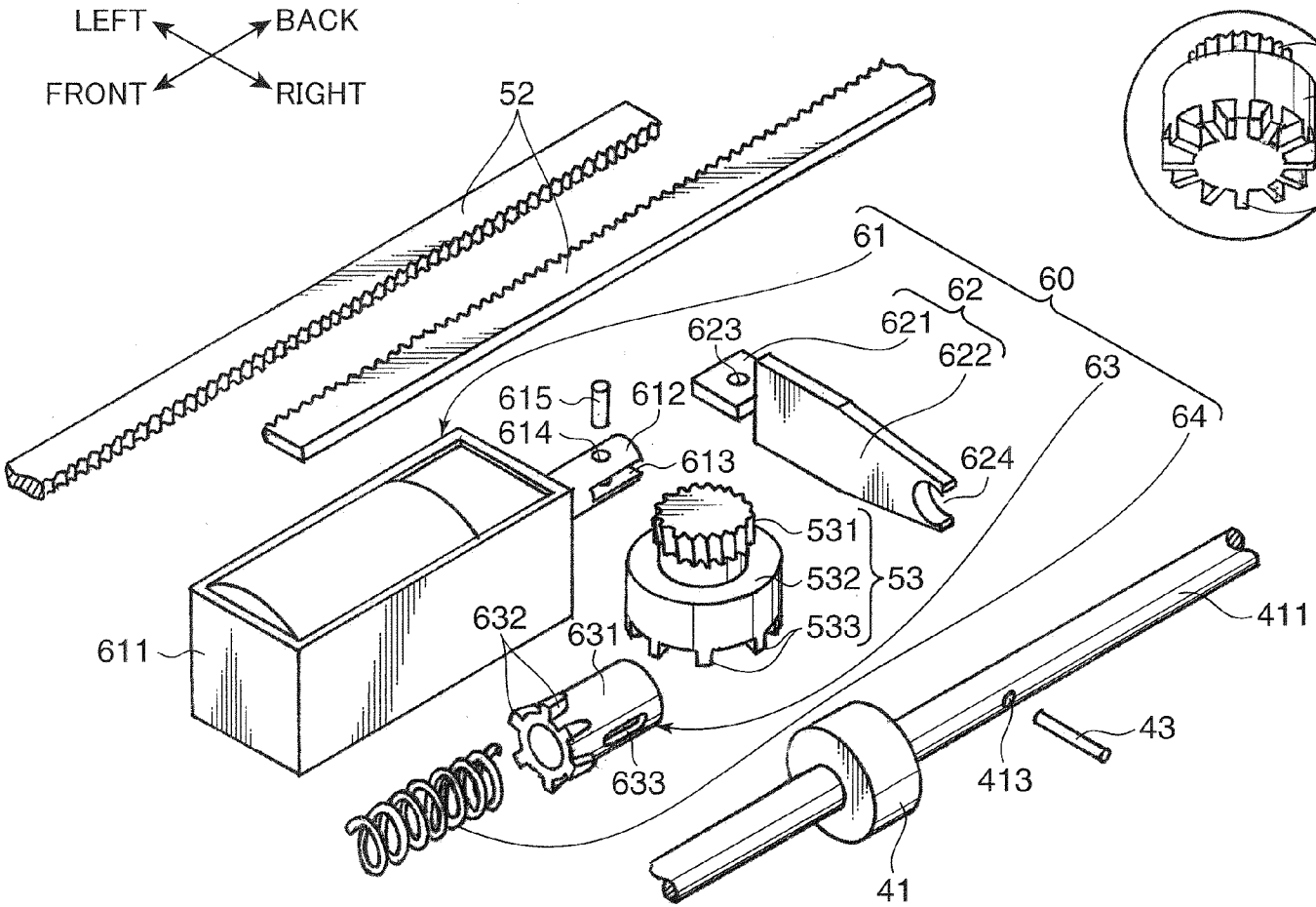
FIG. 7A is an exploded perspective view showing one embodiment of a transmission assembly.
Figure 8A:
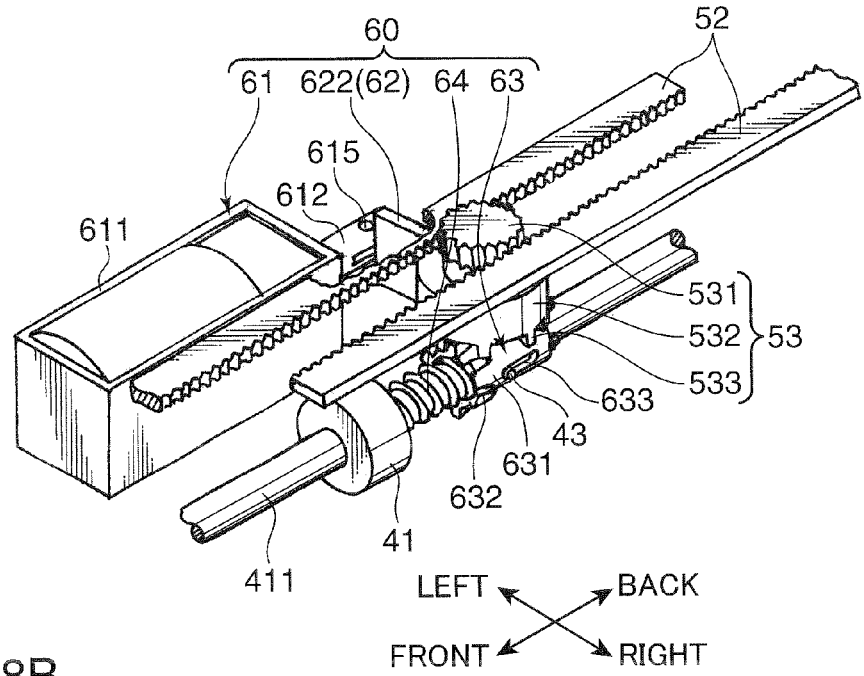
FIG. 8A is an perspective view in the one embodiment of the transmission assembly, where a magnetic rod of an actuator shown in FIG. 8A is located at a projecting position.
Figure 8B:
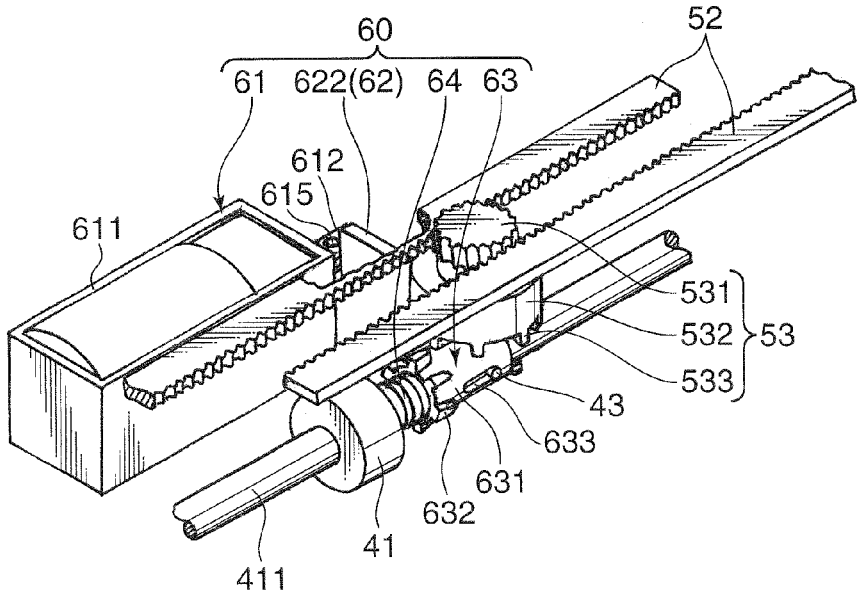
FIG. 8B is an perspective view of the one embodiment of the transmission assembly, where the magnetic rod of the actuator shown in FIG. 8A is located at a retracted position.

FIG. 7A is an exploded perspective view of the transmission assembly 60. FIG. 7B is a perspective view of the rotor 53 from the bottom. FIGS. 8A and 8B are assembled configurations of the transmission assembly 60. The mount base 534 is not shown in FIGS. 7A, 8A and 8B in order to clearly show the structure of the transmission assembly 60. The transmission assembly 60 is described with reference to FIG. 4 as well as FIGS. 7A, 7B, 8A and 8B.

As described above, the transmission assembly 60 (transmitting portion) for transmitting a driving force from the motor M to the racks 52 and the rotor 53 is used to move the pressing plates 54 along the right side plate 34 of the casing 30. The transmission assembly 60 includes an actuator 61 (first actuator, second actuator). The actuator 61 includes a substantially rectangular parallelepipedic housing 611, a solenoid switch (not shown) incorporated in the housing 611, a coil spring (not shown) and a magnetic rod 612 including a proximal end connected with the solenoid switch and a distal end outside the housing 611. The proximal end of the magnetic rod 612 is located in front side than the distal end thereof.

As shown in FIG. 4, the housing 611 is disposed adjacent to the front guide plate 351 and below the front guide plate 351. The coil spring in the housing 611 biases the magnetic rod 612 backward. Accordingly, as shown in FIG. 8A, the magnetic rod 612 is positioned at a projecting position to project backward before power supply to the solenoid switch in the housing 611. After the power supply to the solenoid switch in the housing 611 to excite the solenoid switch, the solenoid switch pulls the magnetic rod 612 into the housing 611 against a biasing force of the coil spring so that the magnetic rod 612 is positioned at a retracted position. Thus the magnetic rod 612 moves along axes of the roller shafts 421.

The substantially cylindrical magnetic rod 612 includes a slit 613 extending from the distal end toward the proximal end of the magnetic rod 612. The magnetic rod 612 further includes a vertically extending through hole 614.

The transmission assembly 60 further includes an operation arm 62. The operation arm 62 includes a substantially rectangular and horizontal mount plate 621 and a vertical arm plate 622 extending rightward from the right edge of the mount plate 621 inserted into the slit 613 of the magnetic rod 612. A vertical though hole 623 is defined in a central part of the mount plate 621. While the mount plate 621 is inserted into the slit 613, the through hole 614 of the magnetic rod 612 and the through hole 623 of the mount plate 621 are vertically aligned. A pin 615 is inserted through the through holes 614, 623 and then swaged, so that the operation arm 62 is attached to the magnetic rod 612. The operation arm 62 does not move relative to the magnetic rod 612.

A distance from the center of the through hole 623 of the mount plate 621 to the distal end of the arm plate 622 is substantially equal to a distance from an axis of the magnetic rod 612 to an axis of the roller shaft 411 of the upper rollers 41. A semicircular notch 624 is defined in the distal end of the arm plate 622. The notch 624 is complementary to the crosssectional shape of the roller shaft 411 so that the notch 624 is engaged with the roller shaft 411. The notch 624 keeps engaging with the roller shaft 411 during slide of the magnetic rod 612 on the roller shaft 411 between the projecting position and the retracted position.

The transmission assembly 60 further includes a tubular gear 63 between the rear end surface of the second upper roller 41 (see FIG. 4) from the front plate 31 and the operation arm 62. The roller shaft 411 of the upper rollers 41 is inserted through the tubular gear 63 so that the tubular gear 63 slides on the roller shaft 411. Gear teeth 632 are formed along the front end edge of the circumferential surface of the tubular gear 63. The gear teeth 632 are engaged with teeth 533 formed for the rack gear 532 of the rotor 53. A substantially cylindrical trunk portion 631 extending backward from the gear teeth 632 includes a pair of slits 633. The pair of the slits 633 is defined to face each other. The slits 633 extend in parallel with the axis of the roller shaft 411. The roller shaft 411 includes a through hole 413 extending at a right angle to the axis of the roller shaft 411 to communicate with the pair of slits 633. A connector pin 43 is inserted through the pair of slits 633 and the through hole 413. At this time, both ends of the connector pin 43 are engaged with the slits 633. Thus, the rotation of the roller shaft 411 is transmitted to the tubular gear 63, so that the tubular gear 63 and the roller shaft 411 integrally rotate.

The transmission assembly 60 further includes a coil spring 64 (second actuator/first actuator). The coil spring 64 between the rear end surface of the second upper roller 41 (see FIG. 4) from the front plate 31 and the front end surface of the tubular gear 63 surrounds the roller shaft 411. The coil spring 64 biases the tubular gear 63 backward. The tubular gear 63 reciprocates along the roller shaft 411 by movements of the magnetic rod 612 between the projecting position and the retracted position and by the coil spring 64. The slits 633 of the tubular gear 63 define its movable range.

When the magnetic rod 612 moves toward the projecting position as shown in FIG. 8A, the operation arm 62 moves backward while the coil spring extends. At this time, the gear teeth 632 of the tubular gear 63 are engaged with the rack teeth 533 of the rotor 53 (first position).

As shown in FIG. 8B, the magnetic rod 612 moves toward the retracted position when the actuator 61 is activated to excite the solenoid switch. During this time, the arm plate 622 moves forward with pushing the tubular gear 63, so that the coil spring 64 is compressed. Further, the gear teeth 632 and the rack teeth 533 are disengaged (second position). In this way, the driving force of the motor M is selectively transmitted to the rotor 53. The length of the slits 633 of the tubular gear 63 may be defined so that engagement and disengagement between the gear teeth 632 and rack teeth 533 are successfully achieved.

In the case of integrally forming the arm plate 622 and the tubular gear 63, the coil spring 64 is not necessary. In this case, the arm plate 622 and the tubular gear 63 integrally reciprocate as the magnetic rod 612 moves between the projecting position and the retracted position, so that the engagement and disengagement between the gear teeth 632 and the rack teeth 533 may be accomplished. Further, mounting directions of the actuator 61 and/or the coil spring 64 may be changed, so that the tubular gear 63 and the rotor 53 are disengaged when the magnetic rod 612 is at the projecting position while they are engaged when the magnetic rod 612 is at the retracted position.

In place of the above mentioned coil spring 64, a leaf spring, a spiral spring or another element configured to bias the arm plate 622 may be used.

Figures 9A, 9B:
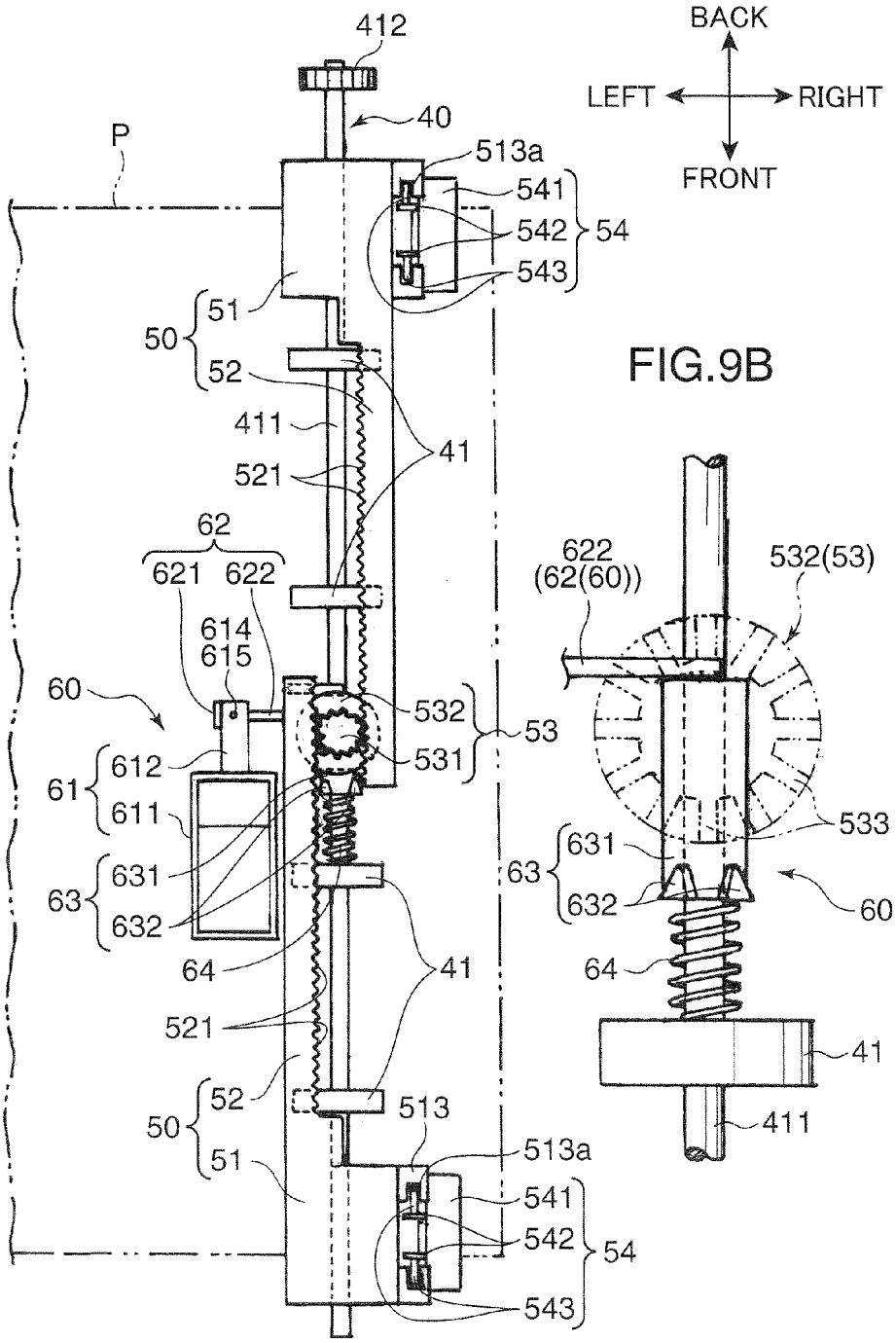
FIG. 9A is a plan view of a correcting portion and the transmission assembly, where the magnetic rod is located at the retracted position where gear teeth and rack teeth are not engaged.
FIG. 9B is an enlarged view showing an engagement between a tubular gear of the transmission assembly shown in FIG. 9A and the rotor.
Figures 10A, 10B:
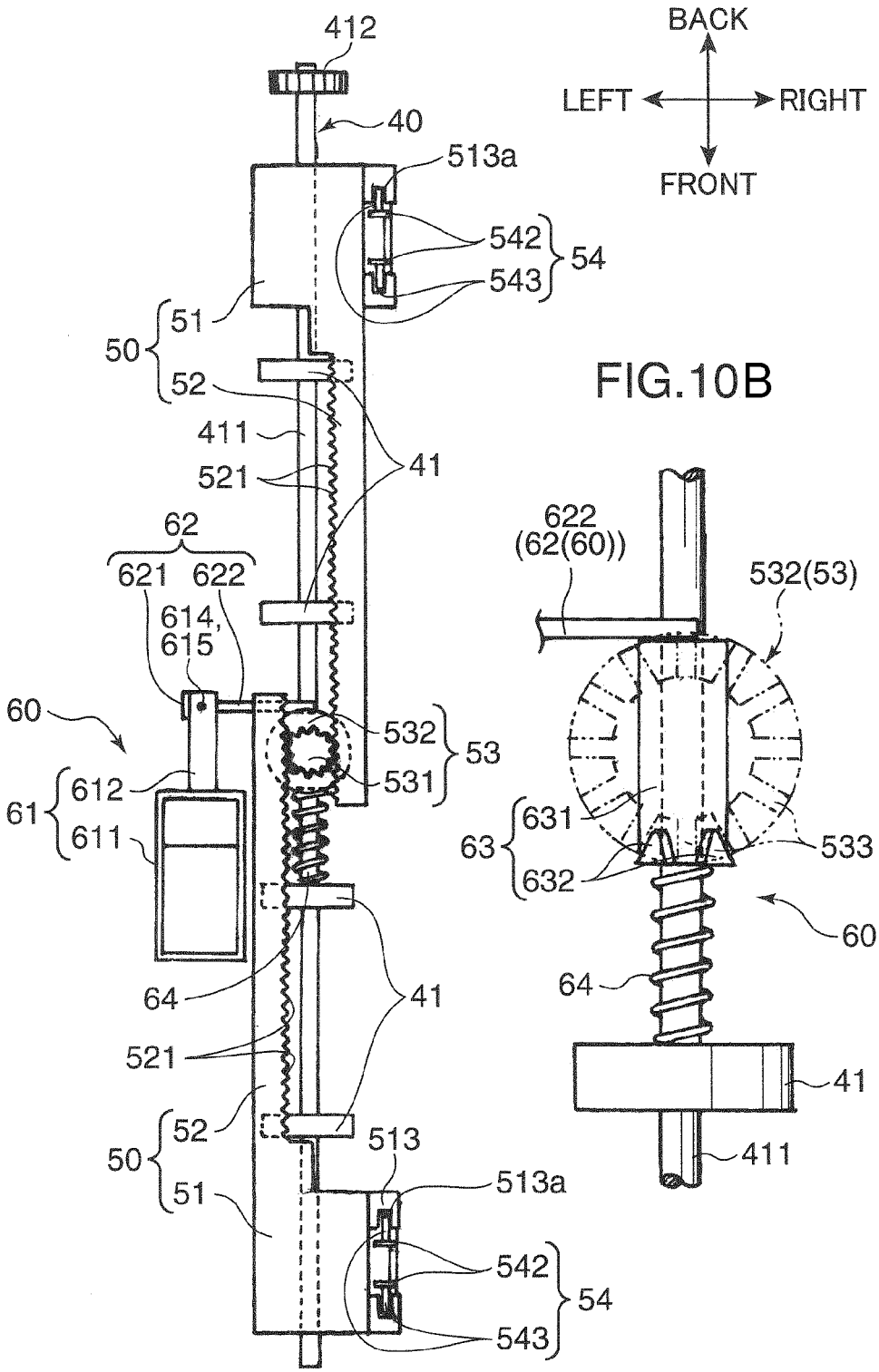
FIG. 10A is a plan view of the correcting portion and the transmission assembly, where the magnetic rod is located at the projecting position where gear teeth and rack teeth are engaged.
FIG. 10B is an enlarged view showing an engagement between the tubular gear of the transmission assembly shown in FIG. 10A and the rotor.

FIG. 9A is a plan view of the transmission assembly 60 including the magnetic rod 612 at the retracted position. In FIG. 9A, the gear teeth 632 and the rack teeth 533 are disengaged. FIG. 9B is an enlarged plan view showing engagement between the tubular gear 63 and the rotor 53 in the transmission assembly 60 and a relative positional relationship among the arm plate 622, the rotor 53, the tubular gear 63 and the coil spring 64. FIG. 10A is a plan view of the transmission assembly 60 including the magnetic rod 612 at the projecting position. In FIG. 10A, the gear teeth 632 are engaged with the rack teeth 533. FIG. 10B is an enlarged plan view showing engagement between the tubular gear 63 and the rotor 53 in the transmission assembly 60 and a relative positional relationship among the arm plate 622, the rotor 53, the tubular gear 63 and the coil spring 64. The operation of the transmission assembly 60 is described with reference to FIGS. 9A to 10B.

A current supplied to the solenoid switch in the housing 611 of the actuator 61 shown in FIG. 9A excites the solenoid switch. As a result, the magnetic rod 612 is refracted into the housing 611 to reach the retracted position. Consequently, the arm plate 622 connected with the magnetic rod 612 moves forward. During this time, the distal end of the arm plate 622 pushes the tubular gear 63 forward in contact with the rear end surface of the tubular gear 63. The tubular gear 63 compresses the coil spring 64 with moving forward. As a result, the gear teeth 632 of the tubular gear 63 are separated from the rack teeth 533 of the rotor 53 so that the gear teeth 632 and the rack teeth 533 are disengaged (see FIG. 9B). Thus, the rotor 53 does not rotate while the roller shaft 411 of the upper rollers 41 rotates. Therefore, the racks 52 and the elements connected therewith (e.g. pressing plates 54) are stationary during this time.

No power is supplied to the solenoid switch in the housing 611 of the actuator 61 shown in FIG. 10A. At this time, the magnetic rod 612 is pushed backward by the coil spring in the housing 611 of the actuator 61 so that the arm plate 622 is pushed backward by the coil spring 64 mounted on the roller shaft 411 of the upper rollers 41. The arm plate 622 and the magnetic rod 612 may be pushed backward using only the coil spring 64. In this case, the coil spring in the housing 611 of the actuator 61 is not necessary. The magnetic rod 612 reaches the projecting position by the above-mentioned coil spring 64 (and/or the coil spring in the housing 611), the tubular gear 63 moves backward and the gear teeth 632 of the tubular gear 63 are engaged with the rack teeth 533 of the rotor 53. As a result, the driving force of the motor M (see FIG. 4) is successively transmitted to the gear 412 mounted on the rear end of the roller shaft 411, the roller shaft 411, the connector pin 43 (see FIG. 7), the trunk portion 631 of the tubular gear 63, the gear teeth 632 and the rack teeth 533. As a result, the rotor 53 rotates so that the pair of racks 52 engaged with the pinion 531 of the rotor 53 move in directions away from or toward each other. The pressing plates 54 connected to the racks 52 move in directions away from or toward each other by movements of the pair of racks 52. Thus, a cutoff period of the power to the solenoid switch may be so controlled as to obtain a distance between the pair of pressing plates 54 equal to a distance between the lateral edges of the sheet P designated, for example, by the user using the operation panel 17 (see FIG. 1). When the distance between the pair of the pressing plates 54 becomes equal to the distance between the lateral edges of the sheet P designated by the user using the operation panel 17 (see FIG. 1), the movements of the pressing plates 54 are stopped by the power supply to the solenoid. Thereafter, the pressing plates 54 may press the lateral edges of the discharged sheet P. Such a control is accomplished, for example, using a controller (e.g. CPU) for controlling the overall operation of the image forming apparatus (see FIG. 1). The controller may conform the distance between the pair of pressing plates 54 to the distance between the lateral edges of the sheet P designated by the user using the operation panel 17 (see FIG. 1), for example, by referring to a rotational angle of the motor M and the input made by the user.

Alternatively the pressing plates 54 may be stationary during the cutoff period of the power to the solenoid switch while the pressing plates 54 may move during a supply period of power to the solenoid switch.

Figure 11:
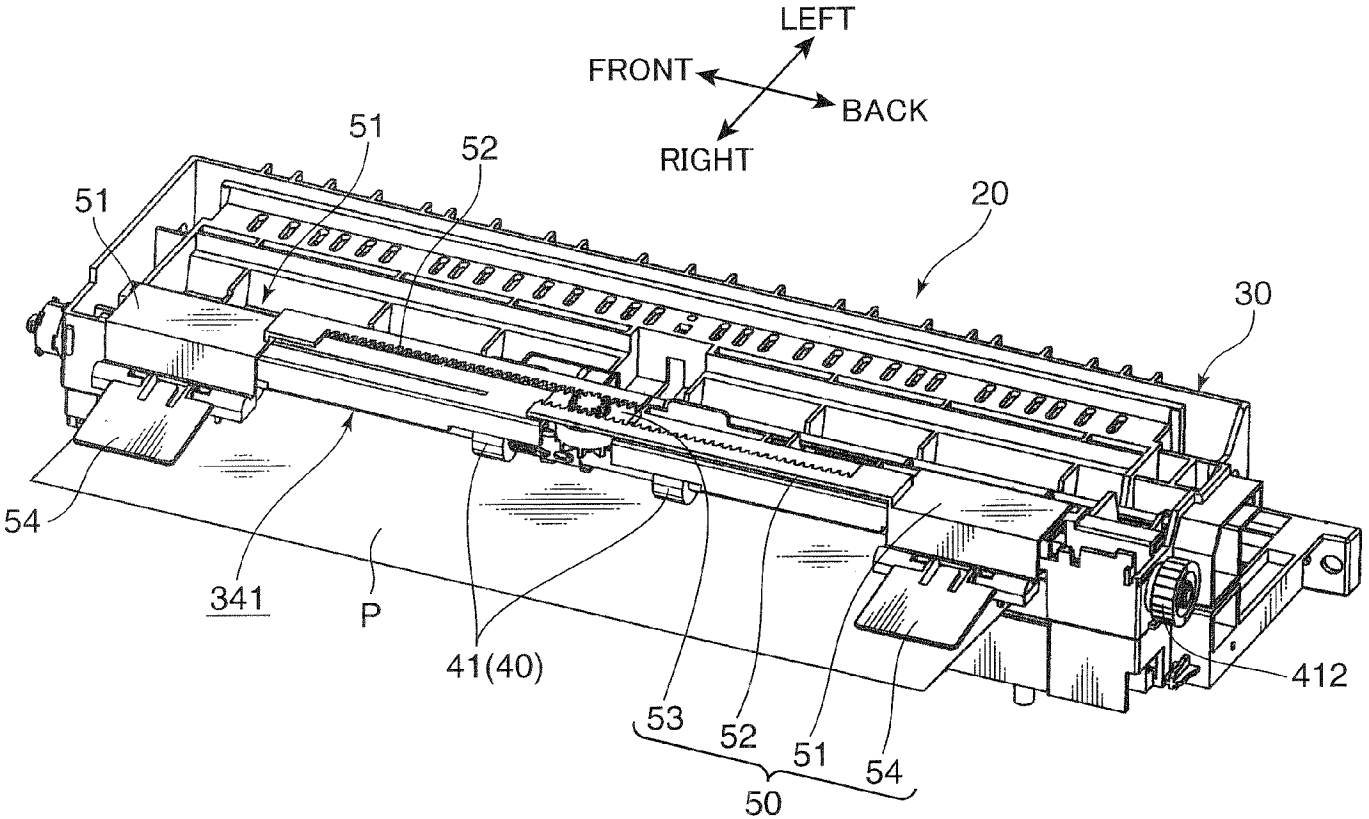
FIG. 11 is a perspective view showing curl correction in the sheet discharging device shown in FIG. 3.

FIG. 11 is a perspective view of the sheet discharging device 20 described with reference to FIGS. 4 to 10, and FIG. 12 is a perspective view of a sheet discharging device 20A including no correcting portion 50. The correction of curls by the pressing plates 54 is described with reference to FIGS. 11 and 12.

Figure 12:
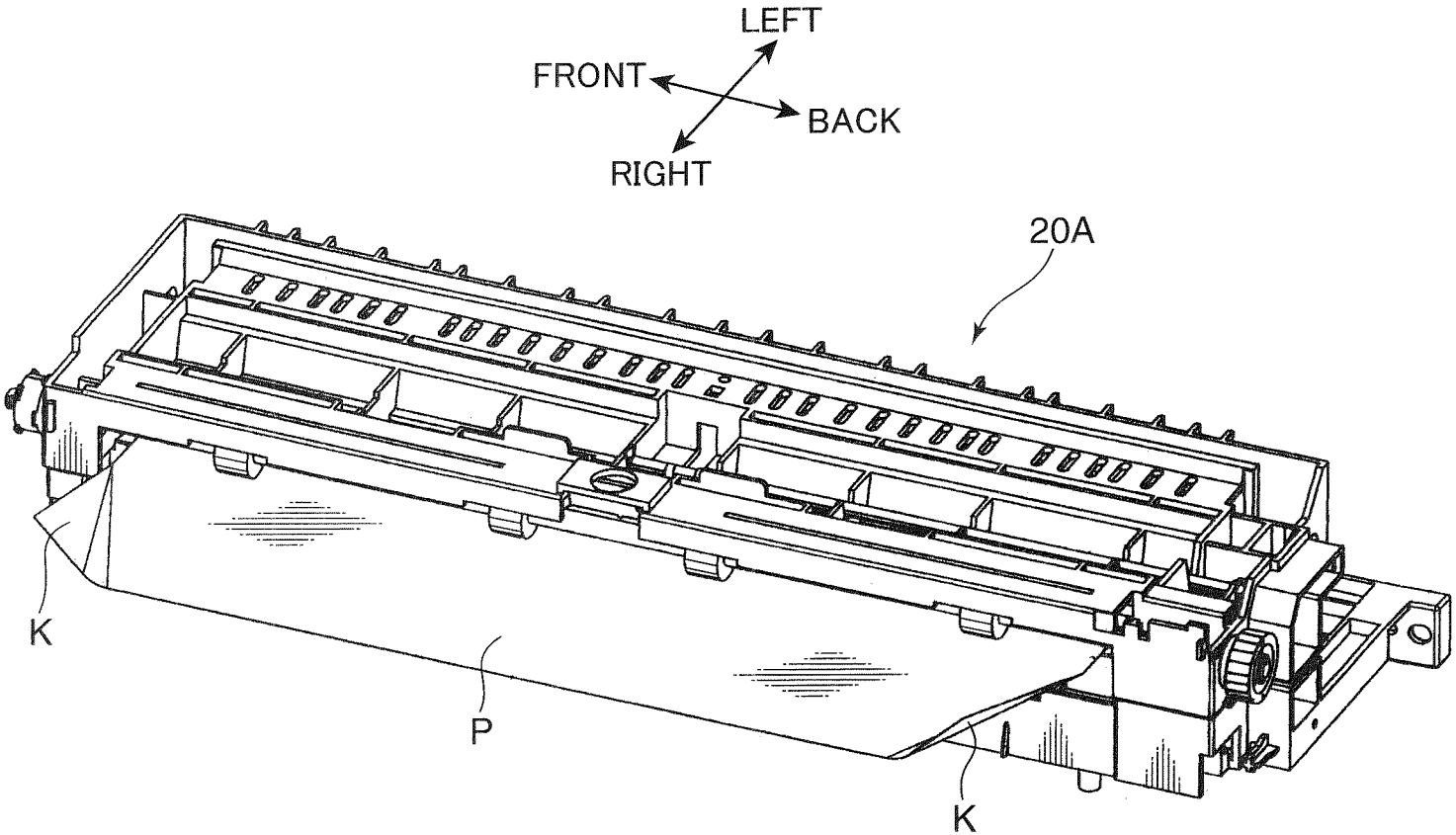
FIG. 12 is a perspective view showing the discharge of the sheet from the sheet discharging device including no correcting portion.

As shown in FIGS. 11 and 12, when the gear 412 is rotated by the motor M (see FIG. 4), the sheet P nipped by the discharge roller pair 40 including the upper roller 41 and the lower roller 42 (see FIG. 4) is discharged. As shown in FIG. 11, the leading edge of the sheet P pushes the pressing plates 54 up so that the pressing plates 54 lies down on the lateral edges of the sheet P. Thus, the pressing plates 54 lie heavy on the curled lateral edges of the sheet P to be corrected. On the other hand, as shown in FIG. 12, the sheet P is discharged with the upwardly curled lateral edges of the sheet P without the correcting portion 50.

The principle of the present invention is also applicable to any arbitrary apparatus including a mechanism for providing heat energy to one surface of a sheet or any other arbitrary apparatus for handling curled sheets, although the image forming apparatus 10 is illustrated in the above embodiment. Further, although the pressing plates 54 are moved using the driving force from the motor configured to drive the discharge roller pair 40 in the above embodiment, the present invention is not limited thereto. For example, a separate driving source may be connected to the rotor 53, so that the pressing plates 54 may be moved thereby.

Although the pair of pressing plates 54 is symmetrically moved with respect to the center of the slit 341 by engaging the racks 52 and the pinion 531 in the above embodiment, the present invention is not limited thereto. A single pressing plate 54 may be moved along the slit 341.

In some embodiment, the image forming apparatus 10 may include sensors for detecting the positions of the lateral edges of the sheet P. The pressing plates 54 may be moved to positions corresponding to the lateral edges of the sheet P according to sensor outputs. A plurality of optical sensors aligned in the width direction of the sheet may be applied to the sensors for detecting the lateral ends of the sheet P.

Although the pair of pressing plates 54 is moved together by engaging the pair of racks 52 and the pinion 531 in the above embodiment, the present invention is not limited thereto. For example, the pair of pressing plates 54 may be moved independently of each other so that the pair of pressing plates 54 may independently move to positions corresponding to the lateral ends of the sheet P. Alternatively, the single pressing plate 54 or one of pressing plates 54 may move to the position corresponding to the lateral edge of the sheet P.

A sheet discharging device according to one aspect of the above embodiment comprises a housing including a first wall; a discharge section configured to discharge a sheet to an outside of the housing through a slit defined in the first wall; a pressing portion attached to the housing so that the pressing portion presses the sheet discharged through the slit outside the slit; and a moving unit configured to move the pressing portion along the slit.

According to the above configuration, the sheet is discharged through the slit defined in the first wall of the housing. The pressing portion is configured to press the sheet. Thus, a curl of the sheet may be appropriately corrected. The moving unit moves the pressing portion along the slit. Therefore, the pressing portion may be appropriately deployed at curled parts of the sheet to correct curl of various sides of the sheets.

In the above configuration, it is preferable that the pressing portion includes a first pressing portion and a second pressing portion.

According to the above configuration, the curl of the sheet may be corrected at a plurality of positions.

In the above configuration, it is preferable that the first and second pressing portions are preferably movable in different directions along the slit.

According to the above configuration, the first and the second pressing portions are movable in different directions along the slit.

In the above configuration, it is preferable that the first and the second pressing portions are preferably symmetrically movable with respect to the center of the slit.

According to the above configuration, the first and second pressing portions may be further efficiently moved to appropriate positions according to a change in the sheet size.

In the above configuration, it is preferable that the sheet is a first sheet or a second sheet with a width different from that of the first sheet; and the pressing portion is movable between a first pressing position for pressing a lateral edge of the first sheet and a second pressing position for pressing a lateral edge of the second sheet.

According to the above configuration, the pressing portion may be efficiently moved to an edge portion of the sheet according to a change in the sheet size.

In the above configuration, it is preferable that the pressing portion presses an upper surface of the sheet by the weight thereof.

According to the above configuration, the sheet discharging device may be simply configured without any special mechanism for pressing the sheet to correct its curl.

In the above configuration, it is preferable that the pressing portion includes a shaft rotatably mounted in the housing above the slit.

According to the above configuration, the pressing portion may be rotatably supported.

In the above configuration, it is preferable that the pressing portion is rotated upward by the sheet discharged through the slit.

According to the above configuration, the pressing portion may not interfere with the discharge of the sheet.

In the above configuration, it is preferable that the discharge section discharges the sheet after one surface of the sheet is heated; and the moving unit includes: a first rack connected to the first pressing portion so that the first rack extends along the slit, a second rack connected to the second pressing portion so that the second rack extends along the slit, and a rotor including a pinion engaged with the first and the second racks.

According to the above configuration, both edges of the sheet are curled by heating one surface of the sheet. The first rack, the second rack and the pinion engaged with these racks symmetrically move the first and second pressing portions with respect to each other. Thus, the first and the second pressing portions are appropriately deployed to correct the curls at both edges of the sheet.

In the above configuration, it is preferable that the sheet discharging device further comprises a driving source configured to rotate the rotor in forward and reverse directions.

According to the above configuration, switching a rotating direction of the driving source may selectively change moving directions of the first and the second pressing portions away from each other or toward each other.

In the above configuration, it is preferable that the sheet discharging device further comprises a transmitting portion configured to transmit a driving force of the driving source from the discharge section to the rotor, wherein: the discharge section includes a shaft to be rotated by the driving source and a roller integrally rotated with the shaft and configured to discharge the sheet through the slit; the transmitting portion includes a tubular gear mounted on the shaft so that the tubular gear rotates together with the shaft; and the rotor includes rack teeth engageable with the tubular gear.

According to the above configuration, the driving source rotates the shaft and the roller of the discharge section. The tubular gear as the transmitting portion is mounted on the shaft of the discharge section. The tubular gear is engaged with the rack teeth of the rotor. Thus, the driving force from the driving source configured to drive the discharge section is transmitted to the rotor to move the pressing portion. Therefore, the discharge section and the moving unit may be moved using the single driving source, whereby the sheet discharging device may be compact.

In the above configuration, it is preferable that the tubular gear is configured to reciprocate along the shaft between a first position where the tubular gear is engaged with the rack teeth and a second position where the tubular gear is disengaged from the rack teeth.

According to the above figuration, the driving force from the driving source is transmitted to the rotor to move the pressing portion when the tubular gear is at the first position. The driving force from the driving source is not transmitted to the rotor so that the pressing portion may be held stationary when the tubular gear is at the second position.

In the above configuration, it is preferable that the transmitting portion further includes an actuator configured to move the tubular gear between the first position and the second position.

According to the above configuration, it may be selected to transmit or not to transmit the driving force to the moving unit by the operation of the actuator.

In the above configuration, it is preferable that the sheet discharging device further comprise a driving source configured to provide a driving force to operate the discharge section and a transmitting portion configured to transmit the driving force to the moving unit.

According to the above configuration, the discharge section and the moving unit may be operated using the single driving source. Therefore, the sheet discharging device is compact.

In the above configuration, it is preferable that the transmitting portion configured to select whether the driving force is transmitted to the moving unit.

According to the above configuration, the moving unit may move the pressing portion to a specified position as necessary, and then, may stop the pressing portion. Thus, the pressing portion may appropriately correct a curl of the sheet at an appropriate position.

In the above configuration, it is preferable that the transmitting portion further includes a first actuator configured to move the tubular gear to the first position and a second actuator configured to move the tubular gear to the second position.

According to the above configuration, the driving force may be transmitted from the driving source to the moving unit by operating the first actuator so that the transmission of the driving force from the driving source to the moving unit may be stopped by operating the second actuator.

In the above configuration, the first actuator or the second actuator preferably includes a solenoid switch configured to move a magnetic rod in a direction parallel with an axis of the shaft, and an operation arm connected with the magnetic rod so that the operation arm is held in contact with an end portion of the tubular gear. At this time, the second actuator or the first actuator is preferably a biasing member configured to bias the tubular gear toward the second position. Further, the second actuator may be a coil spring surrounding the shaft.

According to the above configuration, the tubular gear moves to the first position or the second position by the operation of the solenoid switch and is returned to the second position or the first position by the biasing member (coil spring).

An image forming apparatus according to another aspect of the above embodiment comprises an image forming unit configured to form a toner image on a sheet; a fixing unit configured to fix the toner image to the sheet by providing heat to the sheet; and a sheet discharging device configured to discharge the sheet bearing the toner image fixed thereof, wherein the sheet discharging device includes: a housing including a first wall; a discharge section configured to discharge a sheet to an outside of the housing through a slit defined in the first wall; a pressing portion attached to the housing so that the pressing portion presses the sheet discharged through the slit outside the slit; and a moving unit configured to move the pressing portion along the slit.

According to the above configuration, the toner image formed on the sheet by the image forming unit is fixed onto the sheet by the heat of the fixing unit. The heat of the fixing unit curls the lateral edges of the sheet. The sheet is discharged through the slit defined in the first wall of the housing. The pressing portion is configured to press the sheet. Thus, a curl of the sheet may be appropriately corrected. The moving unit moves the pressing portion along the slit. Therefore, the pressing portion may be appropriately deployed at curled parts of sheets to correct curls of various sizes of sheets.

In the above configuration, it is preferable that the pressing portion includes a first pressing portion and a second pressing portion.

According to the above configuration, curls of the sheet may be corrected at a plurality of positions.

In the above configuration, it is preferable the first and the second pressing portions are movable in different directions along the slit.

According to the above configuration, the first and the second pressing portions may be efficiently moved to appropriate positions according to a change in the sheet size.

In the above configuration, it is preferable that the moving unit includes: a first rack connected to the first pressing portion so that the first rack extends along the slit, a second rack connected to the second pressing portion so that the second rack extends along the slit, and a rotor including a pinion engaged with the first and the second racks.

According to the above configuration, the first pressing portion and the second pressing portion symmetrically move with respect to each other along the slit. Thus, the first and the second pressing portions may be appropriately deployed at positions corresponding to the both lateral edges of the sheet to correct its curls.

This application claims priority to Japanese Patent Application Serial Number 2008-319411, filed on Dec. 16, 2008 by at least one common inventor, and which is incorporated herein by reference in its entirety.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A sheet discharging device, comprising:

a housing including a first wall;

a discharge section configured to discharge a sheet to an outside of the housing through a slit defined in the first wall, the discharge section discharging the sheet after one surface of the sheet is heated, the sheet being a first sheet or a second sheet with a width different from that of the first sheet;

first and second pressing portions attached to the housing so that the pressing portions press an upper surface of the sheet discharged through the slit outside the slit, the pressing portions being movable between a first pressing position for pressing a lateral edge of the first sheet and a second pressing position for pressing a lateral edge of the second sheet;

a moving unit configured to be mounted on the housing, to support the pressing portions rotatably thereon and to move the pressing portions along the slit, the moving unit including a first rack connected to the first pressing portion so that the first rack extends along the slit, a second rack connected to the second pressing portion so that the second rack extends along the slit, and a rotor including a pinion engaged with the first and the second racks;

a driving source configured to rotate the rotor in forward and reverse directions; and a transmitting portion configured to transmit a driving force of the driving source from the discharge section to the rotor, wherein:

the discharge section includes a roller shaft to be rotated by the driving source and a roller integrally rotated with the roller shaft and configured to discharge the sheet through the slit;

the transmitting portion includes a tubular gear mounted on the roller shaft so that the tubular gear rotates together with the roller shaft; and the rotor includes rack teeth engageable with the tubular gear.

2. The sheet discharging device according to claim 1, wherein the first and the second pressing portions are movable in different directions along the slit.

3. The sheet discharging device according to claim 2, wherein the first and second pressing portions are symmetrically movable with respect to a center of the slit.

4. The sheet discharging device according to claim 1, wherein the pressing portions press an upper surface of the sheet by the weight thereof.

5. The sheet discharging device according to claim 4, wherein the pressing portions includes a shaft rotatably mounted in the housing above the slit.

6. The sheet discharging device according to claim 5, wherein the pressing portions are rotated upward by the sheet discharged through the slit.

7. The sheet discharging device according to claim 1, wherein the tubular gear is configured to reciprocate along the roller shaft between a first position where the tubular gear is engaged with the rack teeth and a second position where the tubular gear is disengaged from the rack teeth.

8. The sheet discharging device according to claim 7, wherein the transmitting portion further includes an actuator configured to move the tubular gear between the first position and the second position.

9. A sheet discharging device, comprising:

a housing including a first wall having a slit;

a discharge section configured to discharge a sheet to an outside of the housing through the slit in the first wall;

a pressing portion attached to the housing so that the pressing portion presses an upper surface of the sheet discharged through the slit outside the slit; and a moving unit configured to be mounted on the housing, to support the pressing portion rotatably thereon and to move the pressing portion along the slit; wherein the discharge section includes a roller shaft to be rotated and a roller integrally rotated with the roller shaft and configured to discharge the sheet through the slit; further comprising:

a driving source configured to rotate the roller shaft in forward and reverse directions; and a transmitting portion configured to transmit a driving force of the driving source from the roller shaft of the discharge section to the moving unit, thereby moving the pressing portion along the slit.

10. An image forming apparatus, comprising:

an image forming unit configured to form a toner image on a sheet;

a fixing unit configured to fix the toner image to the sheet by providing heat to the sheet; and a sheet discharging device configured to discharge the sheet bearing the toner image fixed thereof, wherein the sheet discharging device includes:

a housing including a first wall having a slit;

a discharge section including a roller shaft to be rotated and a roller integrally rotated with the roller shaft and configured to discharge a sheet to an outside of the housing through the slit in the first wall;

a driving source configured to rotate the roller shaft in forward and reverse directions;

a pressing portion attached to the housing so that the pressing portion presses an upper surface of the sheet discharged through the slit to the outside; and a moving unit configured to be mounted on the housing, to support the pressing portion rotatably thereon and to move the pressing portion along the slit; and a transmitting portion configured to transmit a driving force of the driving source from the roller shaft of the discharge section to the moving unit.

11. A sheet discharging device, comprising:

a housing including a first wall having a slit therein;

a discharge section configured to discharge a sheet to an outside of the housing through the slit in the first wall after one surface of the sheet is heated, the sheet being a first sheet or a second sheet with a width different from that of the first sheet;

a pressing portion attached to the housing so that the pressing portion presses the sheet discharged through the slit outside the slit, the pressing portion being movable between a first pressing position for pressing a lateral edge of the first sheet and a second pressing position for pressing a lateral edge of the second sheet;

a moving unit configured to move the pressing portion along the slit, the moving unit including:

a first rack connected to the first pressing portion so that the first rack extends along the slit, a second rack connected to the second pressing portion so that the second rack extends along the slit, and a rotor including a pinion engaged with the first and the second racks; further comprising:

a driving source configured to rotate the rotor in forward and reverse directions; and a transmitting portion configured to transmit a driving force of the driving source from the discharge section to the rotor, wherein:

the discharge section includes a roller shaft to be rotated by the driving source and a roller integrally rotated with the roller shaft and configured to discharge the sheet through the slit;

the transmitting portion includes a tubular gear mounted on the roller shaft so that the tubular gear rotates together with the roller shaft; and the rotor includes rack teeth engageable with the tubular gear.

* * * * *